United States Patent [19]

Fasola

[11] Patent Number: 4,801,909

[45] Date of Patent: Jan. 31, 1989

[54] ELECTROMAGNETIC DEVICE FOR CONTROLLING CURRENT TO A STARTER MOTOR

[75] Inventor: Giancarlo Fasola, Milan, Italy

[73] Assignee: Industrie Magneti Marelli S.r.l., Milan, Italy

[21] Appl. No.: 81,198

[22] Filed: Aug. 4, 1987

[30] Foreign Application Priority Data

Aug. 7, 1986 [IT] Italy ..... 67637 A/86

[51] Int. Cl.[4] ..... H01H 67/02

[52] U.S. Cl. ..... 335/126; 335/196; 361/8

[58] Field of Search ..... 335/131, 132, 201, 196, 335/126; 200/144 R, 146 R, 145; 361/3, 2, 8

[56] References Cited

U.S. PATENT DOCUMENTS 3,513,275 5/1970 Cellerini et al. ..... 200/146 R 3,542,987 11/1970 Levy ..... 200/146 R 4,604,597 8/1986 Bogner et al. ..... 335/131

*Primary Examiner*—E. A. Goldberg

*Assistant Examiner*—Lincoln Donovan

*Attorney, Agent, or Firm*—Sughrue, Mion, Zinn, Macpeak & Seas

[57] ABSTRACT

An electromagnetic device for controlling the supply of current to an electric starter motor includes a pair of fixed contacts on a support for connection to a power supply and a starter motor, respectively. A movable contact which is adapted to engage both fixed contacts is carried by a movable core of an electromagnet so that upon energization of the electromagnet, the movable contact engages both fixed contacts to complete the circuit to the starter motor. A spring is provided for biassing the movable contact away from the fixed contacts upon de-energization of the electromagnet. A flexible braided conductor is permanently connected between the movable contact and one of the fixed contacts to provide an equipotential electrical connection therebetween.

2 Claims, 3 Drawing Sheets

ELECTROMAGNETIC DEVICE FOR CONTROLLING CURRENT TO A STARTER MOTOR

The present invention relates to an electromagnetic device for controlling the supply of current to the electric starter motor of an internal combustion engine.

More particularly, the invention has for its subject a device comprising:

a support carrying a pair of fixed contacts for connection to a supply and to the starter motor respectively, an electromagnet fixed to the support and including an excitation coil and a movable core carrying a contact which, when the coil is energised, cooperates with the fixed contacts to enable the supply of current to be supplied to the starter motor, and resilient biassing means for thrusting the movable contact away from the fixed contacts again when the coil is de-energised.

In devices of this type made up till now, the movable contact is usually constituted by a metal plate fixed at its centre to the movable member of the electromagnet. The fixed contacts are typically arranged symmetrically relative to the axis of the movable member, at equal distances from the corresponding portions of the movable contact at rest. In known devices, the arrangement of the fixed contacts and the movable contact is thus absolutely symmetrical and, when the coil of the electromagnet is energised, the movable contact can "bounce" several times before coming to rest firmly against the fixed contacts These bounces result in the striking of arcs and the possible local fusion of .the material of the fixed contacts and the movable contact, with the risk of welding ("sticking") of both ends of the movable contact to the fixed contacts. When this occurs, the resilient biassing means may not be able to cause the movable contact to become detached from the fixed contacts and, in this event, the starter motor then remains activated even after the de-energisation of the coil of the electromagnet.

The object of the present invention is to provide a device of the type specified above, which does not have the disadvantage described above.

This object is achieved according to the invention by means of an electromagnetic control device of the aforesaid type, the main characteristic of which lies in the fact that it further includes electrical connection means arranged to establish an equipotential connection between the movable contact and one of the fixed contacts before the movable contact touches the fixed contact as a result of the energisation of the coil.

As will become more apparent from the following, the device according to the invention, by means of the electrical connection means, excludes the possibility of arcs being struck between the movable contact and the fixed contact which are connected by the equipotential electrical connection means. The possibility of the moving contact becoming stuck to this fixed contact is thus prevented and, even if the movable contact becomes welded to the other fixed contact, the resilient biassing means also exert a torque on the movable contact about the point of sticking and are thus easily able to effect its detachment from the fixed contact.

Further characteristics and advantages of the device according to the invention will become apparent from the detailed description which follows with reference to the appended drawings, provided purely by way of non-limiting example, in which.

Figure 1:
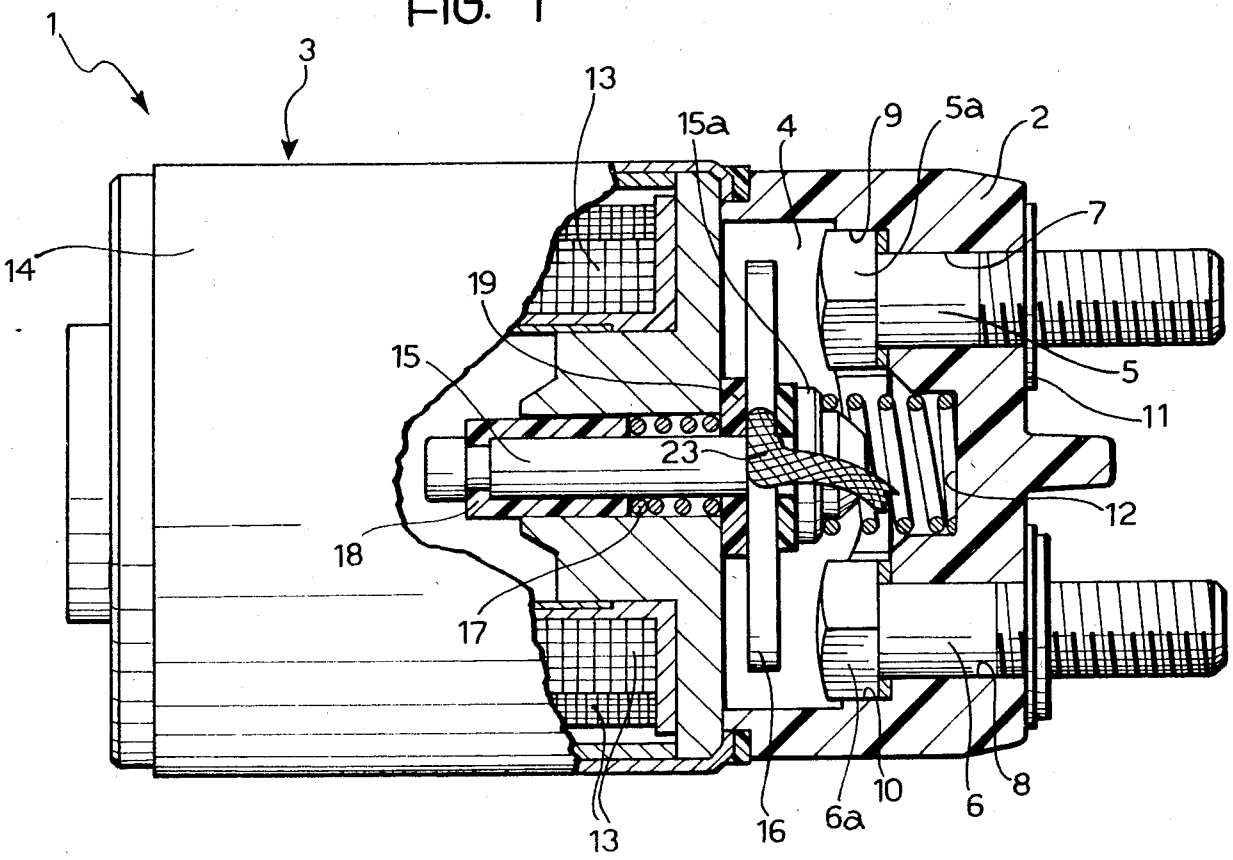
FIG. 1 is a partially-sectioned view of a device according to the invention.

In FIG. 1, the device according to the invention is generally indicated 1. It includes, in known manner, a support 2 to which an electromagnet, generally indicated 3, is fixed in a manner not illustrated. The support 2 has a recess 4 in its surface facing the electromagnet 3. Screws of electrically-conductive material, preferably copper, are indicated 5 and 6 and extend through parallel holes 7 and 8 formed in the support 2. Two seats 9 and 10 are formed in the base of the recess 4, in which the hexagonal heads **5*a* and 6*a* of the screws 5 and 6 are inserted with prismatic coupling. These screws are fixed to the support by washers 11** force- fitted onto the respective threaded shanks.

A substantially cylindrical recess 12 is formed in the bottom of the recess 4 in the support 2, with its axis parallel to the axes of the screws 5 and 6.

In known manner, the electromagnet 3 includes a tubular housing 14 in which an annular excitation coil 13 is housed. The movable core of the electromagnet, indicated 15, has an end head **15*a* which extends into the recess 4 of the support 2. A plate of electrically- conductive material, preferably copper, having, for example, a rectangular shape, is indicated 16**.

Figure 3:
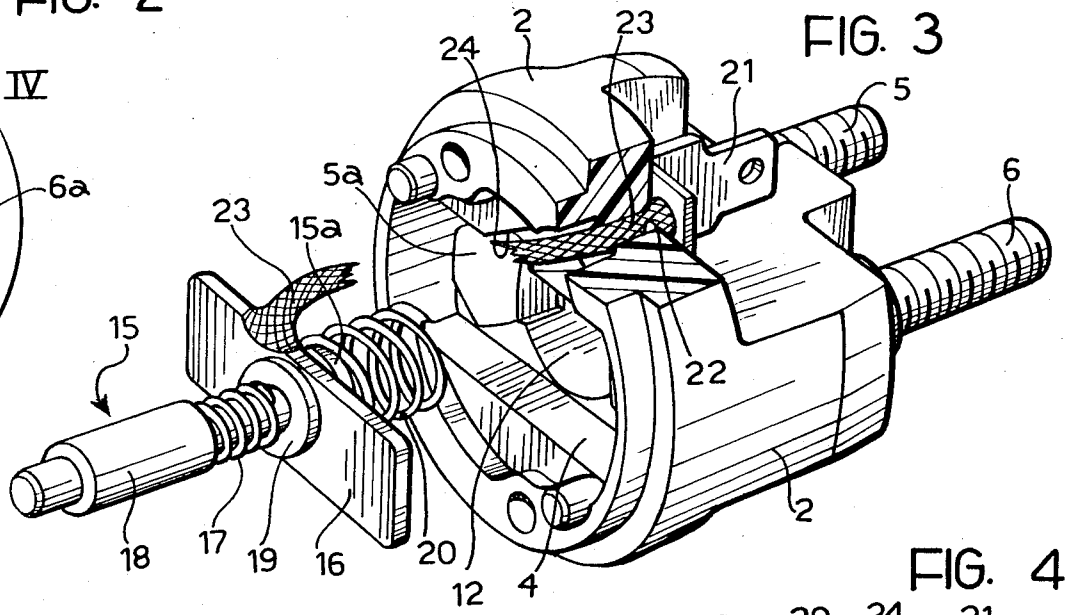
FIG. 3 is a partially-sectioned perspective view of the part of the device of the invention shown in FIG. 2.
Figure 4:
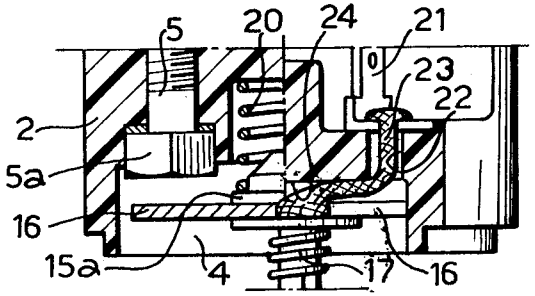
FIG. 4 is a partially-sectioned view taken on the line IV—IV of FIG. 2.
Figure 2:
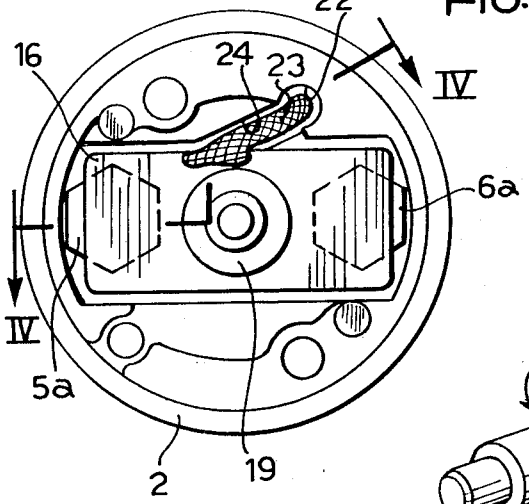
FIG. 2 is a front view of part of the device of FIG. 1.

To the end of the core 15 within the coil 13 is fixed a reaction member 18. A second reaction member, indicated 19, is fitted with slight play onto the core 15 and has a portion which is inserted in a central aperture in the plate 16. A fairly rigid spring 17 is interposed between the reaction members 18 and 19 and keeps the plate 16 against the head **15*a*. A biassing spring 20 is interposed between the head 15*a* and the bottom of the recess 12 in the support. This spring tends to keep the movable member of the electromagnet 3, and particularly the plate 16, away from the heads of the screws 5 and 6 which act as fixed contacts. As shown particularly in FIGS. 3 and 4, a blade-type electrical connecting member 21 is fixed, for example by rivetting, to the support 2 and is connected (in a manner not shown in the drawings) to the screw 6. In the embodiment illustrated, the member 21 is bent into an L shape and is connected to the support 2 close to a hole 22 formed in the support parallel to the axes of the screws 5 and 6. A braid 23 of electrically-conductive material, preferably copper, extends through this hole and has one end welded to the plate 6 acting as a movable contact, and its opposite end welded to the member 21. The braid 23 in fact constitutes a permanent equipotential electrical connection between the movable contact 16 and the fixed contact constituted by the screw 6. As already indicated, the braid extends through the hole 22 in the support and through a groove 24 (FIGS. 2 to 4) formed in the surface of the support facing the electromagnet 3 adjacent the edges of the recess 4**.

In use, the screw 5 is connected to the positive terminal (or negative terminal) of the battery in the motor vehicle, while the screw 6 is connected to a supply terminal of the electric starter motor. The movable contact 16 and the screws 5 and 6 thus form a switch through which the supply of current to the starter motor is controlled.

When the coil 13 is energised (for example, as a result of a command imparted through the ignition and starter switch), the core 15 and the movable contact 16 are thrust towards the fixed contacts constituted by the heads 5*a* and 6*a* of the scress 5 and 6. The equipotential connection constituted by the braid 23 prevents the striking of an arc between the movable contact 16 and the screw 6. Arcs could occur, however, between the movable contact 16 and the head 5*a* of the screw 5. Should the movable contact become stuck to this screw, the biassing spring 20, in addition to exerting a pressure on the movable contact 16, also applies a moment around the sticking point. This moment, which causes the rotation of the movable contact 16 about the sticking point (rotation allowed by the plays in the assembly and by the spring 17), is able to cause the movable contact to detach itself from the fixed contact 5*a*.

Obviously, the braid 23 must be long enough to allow the relative movement of the movable contact 16 and the fixed contacts 5 and 6. Furthermore, this braid must be of such a size as to be able to withstand the intensity of the current supplied to the starter motor. In fact, once the coil 13 is energised, if the movable contact 16 touches first the fixed contact 5*a* and then the contact 6*a*, the braid 23 is, if only for brief instants, traversed by the current supplied to the starter motor.

The braid 23 may be of a smaller size, however, if the arrangement and/or conformation of the fixed contacts and/or the movable contact is such that the movable contact encounters first the fixed contact connected to the braid and then the other fixed contact, for example, as described in the Italian patent application filed on the same date in the name of the same Applicants.

Figure 5:
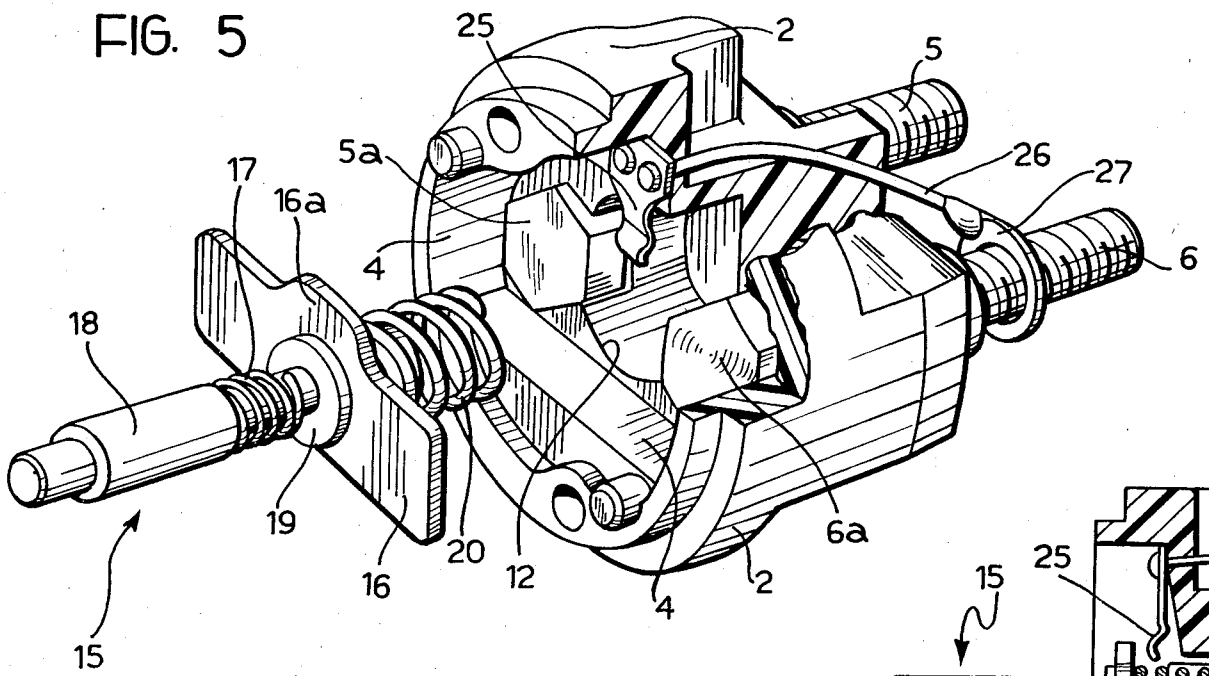
FIG. 5 is a partially-sectioned perspective view of a variant of the device of the invention.
Figure 6:
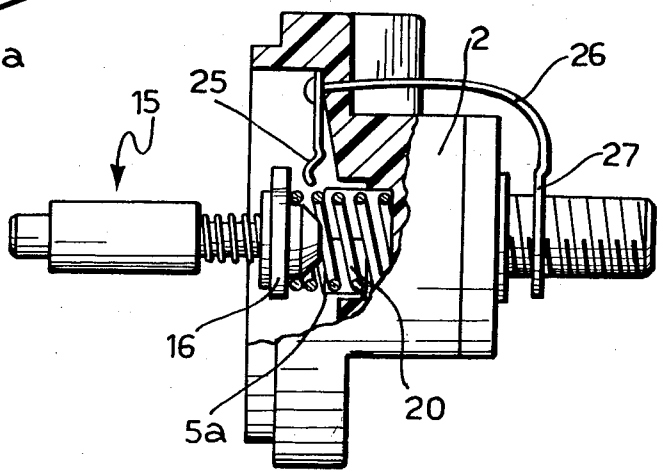
FIG. 6 is a partially-sectioned side view of the part of the device according to the invention shown in FIG. 5.

FIGS. 5 and 6 show a variant of the device described above. In this variant, a supplementary contact 25 in the form of a shaped resilient blade is fixed to the support 4 on its side facing the electromagnet 3. This supplementary contact is connected through a conductor 26 to a metal ring 27 fitted onto the shank of one of the screws 5 and 6.

The movable contact 16 has an appendage 16*a* along a longer side for cooperating with the supplementary contact 25. The latter is shaped and arranged so that, as apparent in FIG. 6, when the coil is de-energised, it is closer to the movable contact 16 (and particularly to the appendage 16*a* of this contact) than the heads 5*a* and 6*a* of the screws 5 and 6. Consequently, when the coil 13 is energised, the movable contact member 16 first encounters the supplementary contact 25 and then the fixed contacts 5*a* and 6*a*. Thus, the supplementary contact member 25 achieves an equipotential electrical connection between the movable contact 16 and the fixed contact 6—6*a* before the movable contact touches the fixed contact. Any possibility of the striking of arcs between the movable contact 16 and the fixed contact 6*a* is thus prevented. Again in this case, any arcs might be struck at most between the movable contact 16 and the fixed contact 5*a*-5. In the event of sticking of the movable contact 16 to the fixed contact, the biassing spring 20 is able to detach it again as a result of the moment it imparts to the movable contact 16 about the sticking point.

With regard to the sizing of the supplementary contact 25, the conductor 26 and the ring 27, the considerations explained above with reference to the braid 23 of the first embodiment described also apply.

Naturally, the principle of the invention remaining the same, the forms of embodiment and details of realisation may be varied widely with respect to those described and illustrated purely by way of non-limiting example, without thereby departing from the scope of the present invention.

I claim:

1. Electromagnetic device for controlling the supply of current to an electric starter motor of an internal combustion engine, comprising:

a support carrying a pair of fixed contacts for connection to a supply and to the starter motor respectively, an electromagnet fixed to the support and including an excitation coil and a movable core carrying a contact which, when the coil is energised, cooperates with the fixed contacts to enable the supply of current to the starter motor, resilient biassing means for thrusting the movable contact away from the fixed contacts again when the coil is de-energised, and electrical connection means arranged to establish an equipotential electrical connection between the movable contact and one of the fixed contacts before the movable contact touches the fixed contact as a result of the energisation of the coil, said electrical connection means including a flexible conductor which permanently connects the movable contact to one of the fixed contacts.

2. A device according to claim 1, wherein the flexible conductor comprises a metal braid, preferably of copper.

* * * * *